US009030271B2

(12) United States Patent
Holme et al.

(10) Patent No.: US 9,030,271 B2
(45) Date of Patent: May 12, 2015

(54) MICROSTRIP MANIFOLD COUPLED MULTIPLEXER

(75) Inventors: Stephen C. Holme, San Ramon, CA (US); Stephen D. Berry, San Ramon, CA (US); Lawrence Alan Carastro, Marietta, GA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 484 days.

(21) Appl. No.: 13/340,095

(22) Filed: Dec. 29, 2011

(65) Prior Publication Data

US 2013/0169379 A1 Jul. 4, 2013

(51) Int. Cl.
*H01P 5/12* (2006.01)

(52) U.S. Cl.
CPC ..... *H01P 5/12* (2013.01)

(58) Field of Classification Search
USPC ..... 333/110, 115, 116, 126–129, 132, 134
See application file for complete search history.

(56) References Cited

U.S. PATENT DOCUMENTS 4,210,881 A * 7/1980 Rubin ..... 333/110
4,688,259 A 8/1987 Edridge
5,281,934 A * 1/1994 Shiau et al. ..... 333/134
7,283,017 B2 10/2007 Galaz Villasante et al.
7,613,434 B2 * 11/2009 Aiga et al. ..... 455/130
2011/0169589 A1 * 7/2011 Franzon et al. ..... 333/134

OTHER PUBLICATIONS

Lai, Ming-Iu, and Jeng, Shyh-Kang,"A Microstrip Three-Port and Four-Channel Multiplexer for WLAN and UWB Coexistence," IEEE Transactions on Microwave Theory and Techniques, vol. 53, No. 10, Oct. 2005.
Llorente-Romano, Sergio, et al., Microstrip Filter and Power Divider with Improved Out-of Band Rejection for a Ku-band Input Multiplexer, 33rd European Microwave Conference, Munich 2003.
Cameron, Richard J., and Yu, Ming, "Design of Manifold Coupled Multiplexers", IEEE Microwave Magazine, Oct. 2007.

* cited by examiner

*Primary Examiner* — Robert Pascal
*Assistant Examiner* — Kimberly Glenn
(74) *Attorney, Agent, or Firm* — Weaver Austin Villeneuve & Sampson LLP

(57) ABSTRACT

A multiplexer includes a microstrip manifold, and a filter bank having at least two output filters. The multiplexer channelizes an input radio frequency (RF) band of electromagnetic energy into a set of output channels by way of the filter bank. The microstrip manifold has an input port that receives an input RF signal, and at least two output ports. The microstrip manifold distributes the input RF signal to each output port, each said output port being coupled to a respective one of the at least two output filters. The multiplexer may be an input multiplexer for a spacecraft communications payload system.

15 Claims, 3 Drawing Sheets

MICROSTRIP MANIFOLD COUPLED MULTIPLEXER

TECHNICAL FIELD

This invention relates generally to a multiplexer, and particularly to a miniaturized manifold coupled multiplexer incorporating a microstrip manifold.

BACKGROUND OF THE INVENTION

The assignee of the present invention manufactures and deploys spacecraft for, inter alia, communications and broadcast services from geostationary orbit. Payload systems of such spacecraft conventionally employ input multiplexers to channelize a radio frequency band of electromagnetic energy into a set of channels by use of a filter bank. The mass, efficiency, cost, and complexity of a multiplexer are important factors in determining the overall performance of the payload system.

Known input multiplexers couple the filter bank to an input RF signal by way of waveguide or coaxial manifolds that may or may not include circulators, as disclosed, for example, by Edridge, U.S. Pat. No. 4,688,259, assigned to the assignee of the present invention and incorporated by reference herein in its entirety. Such techniques result in multiplexer designs of substantial size and weight, and are difficult or impossible to tune once integrated.

As a result, improved multiplexer designs are desirable.

SUMMARY OF INVENTION

The present inventors have found that an input multiplexer configured to use a microstrip manifold for coupling the filter bank to the input RF signal, while avoiding the use of circulators and waveguide or coaxial manifold, provides superior electrical performance (lower insertion loss), and is more easily tuned, while providing a substantial reduction in mass and size relative to conventional designs.

In an embodiment, a multiplexer includes a microstrip manifold and a filter bank that has at least two output filters. The multiplexer is configured to channelize an input radio frequency (RF) band of electromagnetic energy into a set of output channels by way of the filter bank. The microstrip manifold has an input port configured to receive an input RF signal, and at least two output ports. The microstrip manifold is configured to distribute the input RF signal to each output port. Each output port is coupled to a respective one of the at least two output filters.

In an embodiment, each of the at least two output filters may be a high Q bandpass filter. The microstrip may be a planar conductive path disposed on a substrate.

In a further embodiment, the multiplexer may be adjustable by way of a tuning screw coupled to a conductive or dielectric pad.

In another embodiment, the multiplexer may be an input multiplexer of a spacecraft communications payload system. The RF signal may be at a frequency range between one and one hundred GHz.

In an embodiment, a manifold coupled multiplexer includes a microstrip configured to receive an input radio frequency (RF) signal at an input port and to distribute the input RF signal to each of at least two output ports, each said output port being coupled to a respective one of the at least two output filters.

In a yet further embodiment, a spacecraft communications payload system includes at least one input multiplexer. The input multiplexer includes a microstrip manifold and a filter bank that has at least two output filters. The input multiplexer is configured to channelize an input radio frequency (RF) band of electromagnetic energy into a set of output channels by way of the filter bank. The microstrip manifold has an input port configured to receive an input RF signal, and at least two output ports. The microstrip manifold is configured to distribute the input RF signal to each output port. Each output port is coupled to a respective one of the at least two output filters

BRIEF DESCRIPTION OF THE DRAWINGS

Features of the invention are more fully disclosed in the following detailed description of the preferred embodiments, reference being had to the accompanying drawings, in which.

Figure 1:
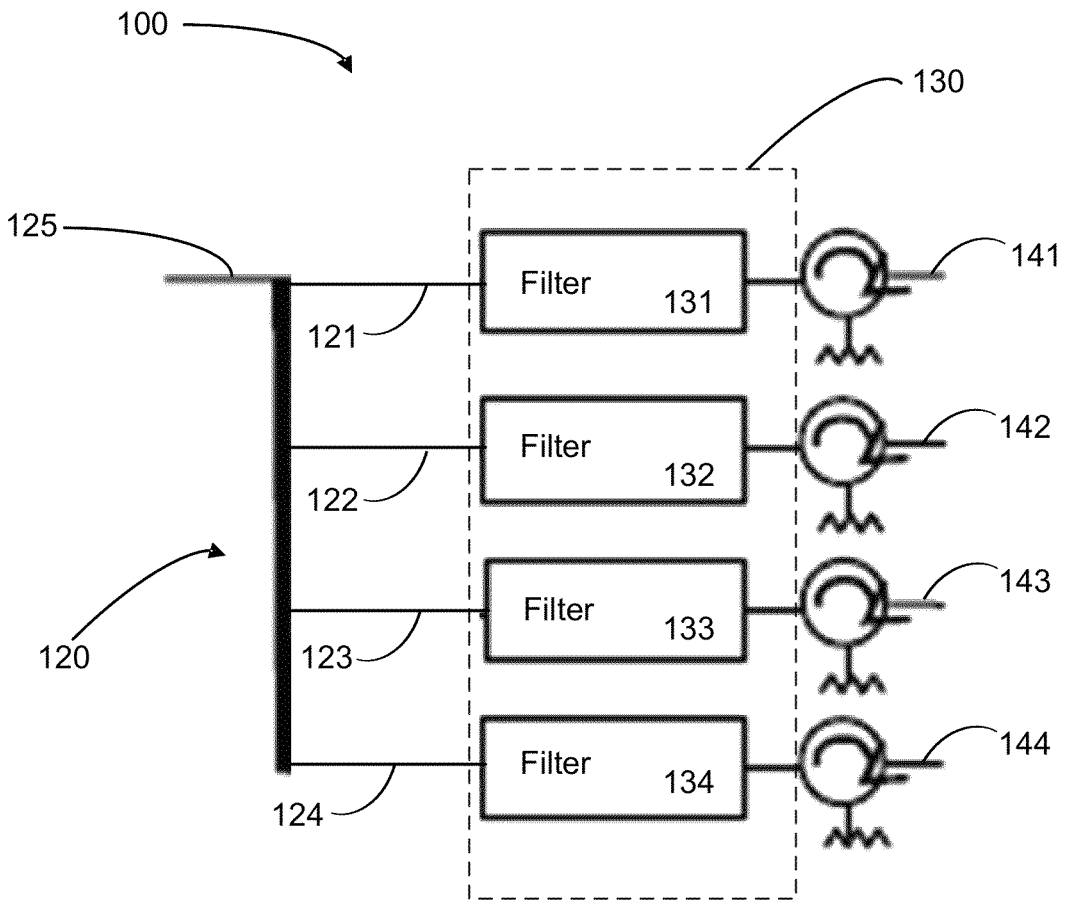
FIG. 1 illustrates an implementation of an input multiplexer.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

Embodiments disclosed herein below achieve a substantial reduction in the mass and envelope dimensions of a multiplexer. For example, an input multiplexer of a spacecraft communications payload system may be particularly improved by use of the presently disclosed techniques. Such an input multiplexer may include a manifold that couples a filter bank to an input radio frequency (RF) signal that may be, for example in a frequency range between one and one hundred gigahertz (GHz).

Referring now to FIG. 1, in an embodiment, multiplexer 100 includes a microstrip manifold 120 and filter bank 130. In the illustrated implementation, filter bank 130 has four filters, filter 131, 132, 133, and 134. It will be understood, however, that a filter bank may include a greater number of filters, or as few as two filters. Microstrip manifold 120 may include input port 125 at which an RF signal may be received. The RF signal may then be distributed by microstrip manifold 120, by way of output ports 121, 122, 123, and 124 to respective filters 131, 132, 133, and 134. Advantageously, each filter may be a high Q bandpass filter. The filters may be, for example, cavity or dielectric resonator filters. Isolators 141, 142, 143, and 144 may be disposed at an output of respective filters 131, 132, 133, and 134. As a result of appropriate selection of filters 131, 132, 133, and 134 multiplexer 100 may be configured to channelize the input RF signal of electromagnetic energy into a respective set of output channels.

Figures 2A, 2B, 2C:
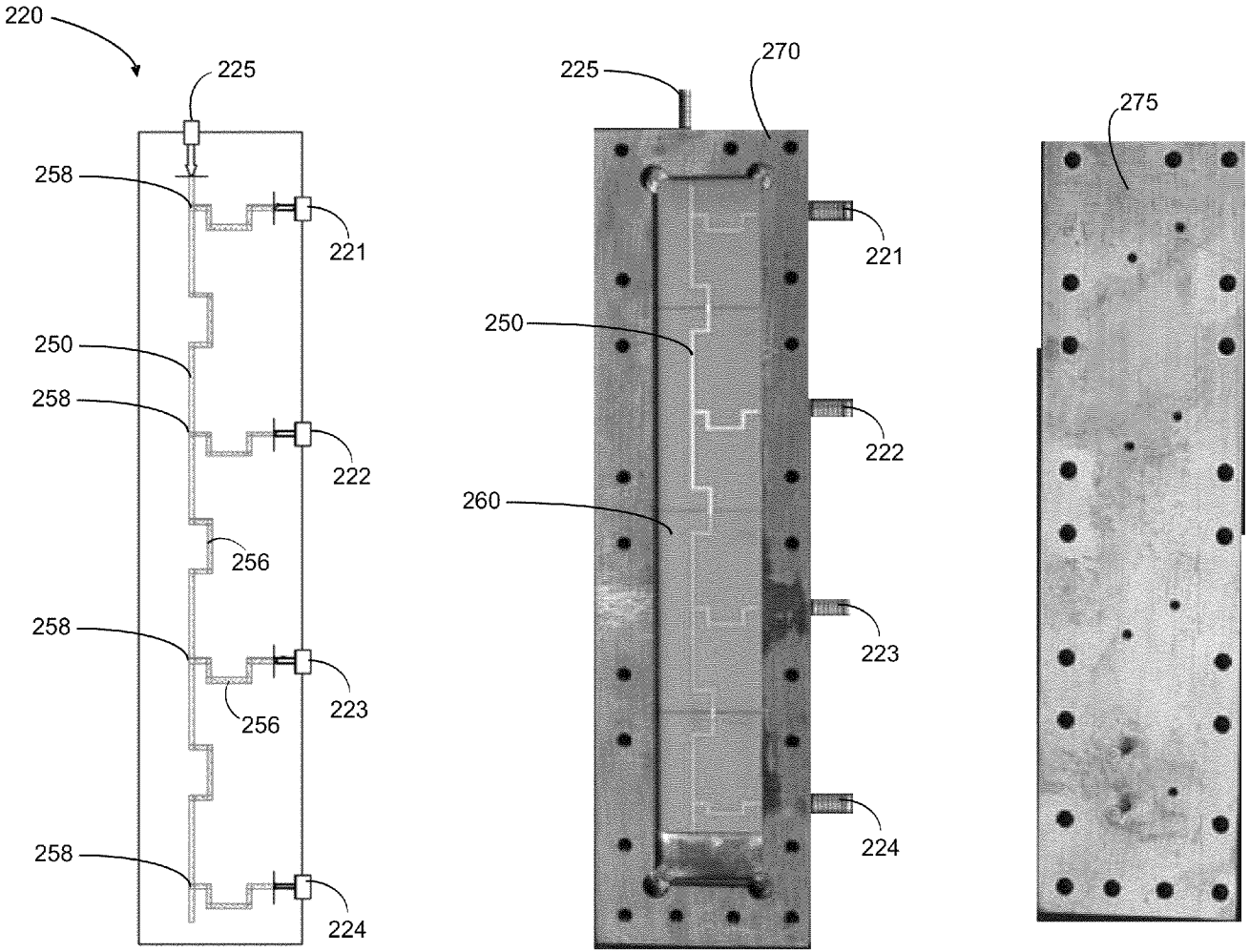
FIG. 2 illustrates an implementation of a planar microstrip manifold for an input multiplexer.

Referring now to FIGS. 2A and 2B, an implementation of a microstrip manifold 220 is illustrated. In the illustrated embodiment, microstrip manifold 220 includes a transmission line 250. Transmission line 250 may be configured to provide a path for an RF signal travelling from input port to 225 to each output port 221, 222, 223, and 224. Transmission line 250 may be a planar conductive strip disposed on, for example a non-conductive or dielectric substrate 260. In some implementations, transmission line 250 may be a highly conductive metal, such as gold or copper deposited on a substrate such as alumina.

In an embodiment, transmission line 250 and substrate 260 may be substantially coplanar and be disposed in low profile enclosure 270. Referring to FIG. 2C, enclosure 270 may have a removable cover 275. Advantageously, transmission line 250 may be configured with meander lines (sometimes referred to as "trombone lines") such as illustrated at 256. As a result of the trombone lines, the electrical line length between input port 225 and any output port 221, 222, 223, and 224 can be changed without changing envelope dimensions of substrate 260 or enclosure 270.

Figure 3B:
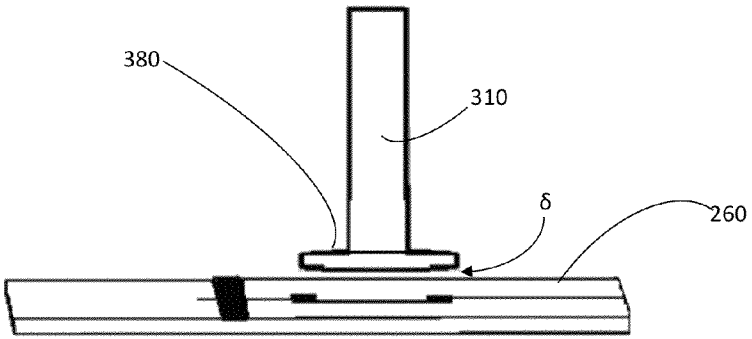
FIG. 3 illustrates in implementation of a tuning arrangement for a microstrip manifold.
Figure 3A:
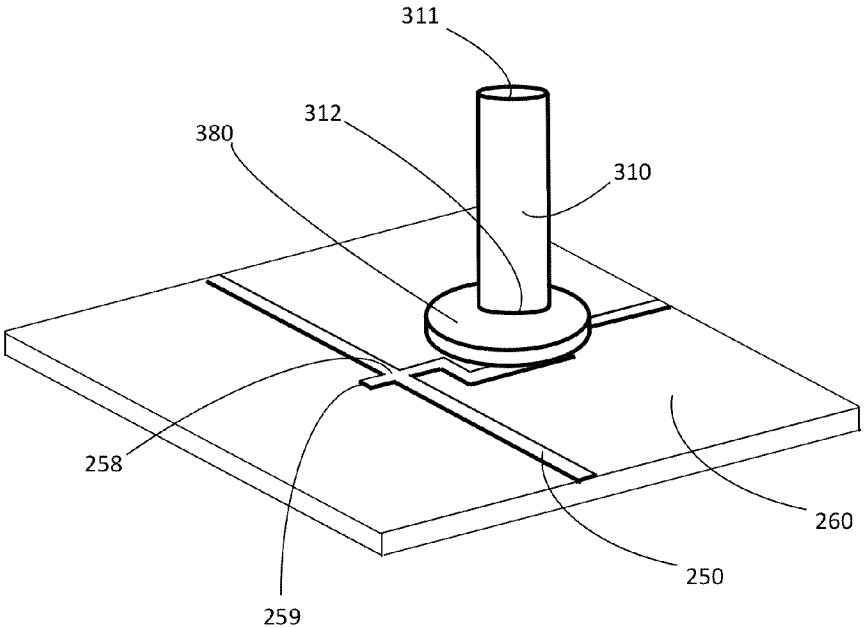

Tuning elements, such as one or more tuning screws, may also be incorporated to enable convenient adjustment of the effective electrical line lengths between, for example, each filter and/or between each filter and input port 225. Advantageously the tuning screws may be arranged such that tuning may be accomplished without removing cover 275. For example, referring now to FIGS. 3A and 3B, an embodiment of a tuning screw 310 is illustrated that may be utilized to change the effective electrical line length of a portion of transmission line 250. FIG. 3A is an isometric view of an arrangement illustrating tuning screw 310 in relation to a portion of substrate 260 and transmission line 250. FIG. 3B illustrates the same arrangement as FIG. 3A, from an angle nearly parallel to the plane of substrate 250. A threaded first end 311 of tuning screw 310 may be engaged with a threaded hole in cover 375 (omitted, for clarity, from FIGS. 3A and 3B), and electrically connected thereto. A second end 312 of tuning screw 310 may be coupled to pad 380. As may be observed in FIG. 3B, a gap distance 'δ' may be provided between substrate 260 and a side of pad 380 proximate to the plane of substrate 260. Distance 'δ' may be adjusted by rotation of tuning screw 310. Pad 380, in an embodiment, may be made of a conductive material that, together with tuning screw 310 and cover 375, provides a conductive path to ground. Rotation of tuning screw 310 permits fine adjustment of gap distance 'δ' which provides a capacitive coupling between transmission line 250 and pad 380. Changing gap distance 'δ' changes the capacitive coupling between transmission line 250 and pad 380, which in turn changes the effective electrical line length of transmission line 250. Pad 380, in another embodiment, may be made of a dielectric material. Changing gap distance 'δ' changes the dielectric constant proximate to transmission line 250, which in turn changes the effective electrical line length of transmission line 250. Additional tuning capability may be provided by configuring input port 225 and/or one or more T-junctions 258 with a variable length tuning stub 259.

Compared to prior art alternatives known to the inventors, the presently disclosed techniques enable an attractive combination of performance features, in addition to qualitative improvements in packaging and tuneability. For example, as shown in Table I, an implementation configured as a Ku-band (12 GHz), four channel input multiplexer has lower mass than all conventional techniques, and considerably less insertion loss than a circulator coupled multiplexer. Moreover, the disclosed manifold coupled multiplexer, unlike a circulator coupled multiplexer can provide a large number of channels.

TABLE 1

| Type | Insertion Loss(manifold only, dB) | Mass(manifold only, grams) | # of Channels |
|---|---|---|---|
| Circulator coupled | 2.00 | 215 | Limited(4 max) |
| Coaxial | 0.67 | 140 | >12 |
| Waveguide | 0.03 | 250 | >12 |
| Microstrip | 1.07 | 120 | >12 |

Thus, a miniaturized manifold coupled multiplexer incorporating a microstrip manifold has been disclosed.

The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. A multiplexer comprising:

a microstrip manifold, the microstrip manifold including at least one planar conductive strip disposed on a non-conductive or dielectric substrate; and a filter bank, external to the microstrip manifold, comprising at least two output filters, wherein:

at least one of the two output filters is a cavity or dielectric resonator filter;

the multiplexer is configured to channelize an input radio frequency (RF) band of electromagnetic energy into a set of output channels by way of the filter bank; and the microstrip manifold has an input port configured to receive an input RF signal, and at least two output ports, the microstrip manifold being configured to distribute, by way of the at least one planar conductive strip, said input RF signal to each of said output ports, each said output port being coupled to a respective input of the at least two output filters.

2. The multiplexer of claim 1, wherein each of the at least two output filters is a high Q bandpass filter.

3. The multiplexer of claim 1, wherein the multiplexer is adjustable by way of a tuning screw coupled to a conductive or dielectric pad.

4. The multiplexer of claim 1, wherein the multiplexer is an input multiplexer of a spacecraft communications payload system.

5. The multiplexer of claim 1, wherein the RF signal is at a frequency range between one and one hundred GHz.

6. A manifold coupled multiplexer, wherein the manifold is a microstrip including at least one planar conductive strip disposed on a non-conductive or dielectric substrate, and is configured to receive an input radio frequency (RF) signal at an input port and to distribute, by way of the at least one planar conductive strip, the input RF signal to each of at least two output ports, each said output port being coupled to a respective input of at least two output filters, at least one of the two output filters being a cavity or dielectric resonator filter.

7. The manifold coupled multiplexer of claim 6, wherein each of the at least two output filters is a high Q bandpass filter.

8. The manifold coupled multiplexer of claim 7, wherein the RF signal is at a frequency range between one and one hundred GHz.

9. The manifold coupled multiplexer of claim 6, wherein the manifold coupled multiplexer is adjustable by way of a tuning screw coupled to a conductive or dielectric pad.

10. The manifold coupled multiplexer of claim 6, wherein the multiplexer is an input multiplexer of a spacecraft communications payload system.

11. A spacecraft communications payload system comprising at least one input multiplexer, the at least one input multiplexer comprising:

a microstrip manifold, the microstrip manifold including at least one planar conductive strip disposed on a non-conductive or dielectric substrate; and a filter bank, external to the microstrip manifold, comprising at least two output filters, wherein:

at least one of the two output filters is a cavity or dielectric resonator filter;

the multiplexer is configured to channelize an input radio frequency (RF) band of electromagnetic energy into a set of output channels by way of the filter bank; and the microstrip manifold has an input port configured to receive an input RF signal, and at least two output ports, the microstrip manifold being configured to distribute, by way of the at least one planar conductive strip, said input RF signal to each of said output ports, each said output port being coupled to a respective input of the at least two output filters.

12. The spacecraft communications payload system of claim 11, wherein each of the at least two output filters is a high Q bandpass filter.

13. The spacecraft communications payload system of claim 11, wherein the multiplexer is adjustable by way of a tuning screw coupled to a conductive or dielectric pad.

14. The spacecraft communications payload system of claim 11, wherein the multiplexer is an input multiplexer of a spacecraft communications payload system.

15. The spacecraft communications payload system of claim 11, wherein the RF signal is at a frequency range between one and one hundred GHz.

* * * * *